US005271552A

United States Patent [19]

McDonnell

[11] Patent Number: 5,271,552

[45] Date of Patent: Dec. 21, 1993

[54] DISPLAY BOX

[75] Inventor: John McDonnell, Cambridge, Canada

[73] Assignee: Brantford Paper Box Company Limited, Brantford, Canada

[21] Appl. No.: 63,599

[22] Filed: May 19, 1993

[30] Foreign Application Priority Data

Dec. 4, 1992 [CA] Canada ..... 2084309

[51] Int. Cl.[5] ..... B65D 5/42

[52] U.S. Cl. ..... 229/162; 206/45.31

[58] Field of Search ..... 229/162; 206/45.31, 206/45.34

[56] References Cited

U.S. PATENT DOCUMENTS

| | | | |
|---|---|---|---|
| 2,337,654 | 12/1943 | Goodyear | 229/162 |
| 3,178,086 | 4/1965 | Palmer | 229/162 |
| 3,199,670 | 8/1965 | Palmer . | |
| 3,273,702 | 9/1966 | Palmer . | |
| 3,292,513 | 12/1966 | Palmer . | |
| 3,301,143 | 1/1967 | Palmer | 229/162 |
| 3,870,221 | 3/1975 | Zeitter . | |
| 4,664,648 | 5/1987 | Dupuy | 206/45.31 |
| 4,733,916 | 3/1988 | Seufert . | |
| 4,826,004 | 5/1989 | Dupuy . | |
| 4,846,775 | 7/1989 | Herrin . | |
| 4,964,563 | 10/1990 | Chaygneaud-Dupuy | 229/162 |
| 5,160,083 | 11/1992 | Lafreniere | 229/162 |

FOREIGN PATENT DOCUMENTS

| | | | |
|---|---|---|---|
| 3937991 | 5/1990 | Fed. Rep. of Germany | 229/162 |
| 2599335 | 12/1987 | France | 229/162 |
| 4-128128 | 4/1992 | Japan | 229/162 |
| 2220643 | 1/1990 | United Kingdom | 229/162 |
| 2245253 | 1/1992 | United Kingdom | 229/162 |

*Primary Examiner*—Gary E. Elkins
*Attorney, Agent, or Firm*—Rogers & Scott

[57] ABSTRACT

A display box has first and second opaque sides meeting at a corner and defining a window opening extending around the corner. A semi-rigid transparent sheet in the window opening overlaps portions of the first and second opaque sides adjacent the window opening and is secured thereto. The transparent sheet has a main fold line extending across the window opening in line with the corners and a corner portion at at least one end of the main fold line. The or each corner portion is formed by a first corner fold line in the transparent sheet adjacent the first opaque side and extending from the window opening to an adjacent end of the transparent sheet, a second corner fold line in the transparent sheet adjacent the second opaque side and extending from the window opening to the adjacent end of the transparent sheet, and a third corner fold line in the transparent sheet between the first and second fold lines and extending from the window opening to the adjacent end of the transparent sheet. When the box is in an erected configuration, the corner portion is raised away from the corner formed by the first and second opaque sides, the raised corner portion having a first segment between the first and third corner fold lines extending away from the first opaque side and a second segment between the first and third fold lines extending away from the second opaque side.

6 Claims, 2 Drawing Sheets

FIG. 1
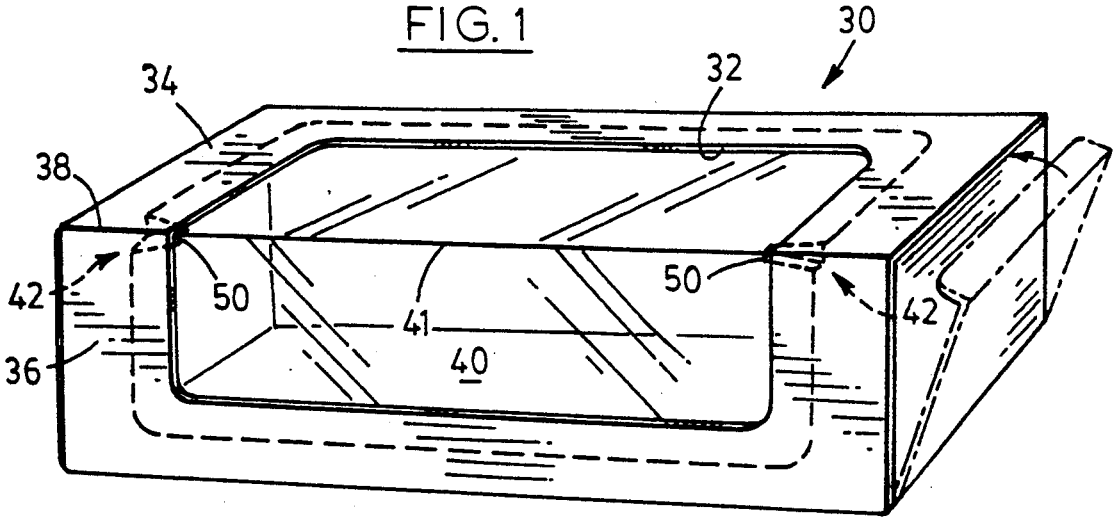
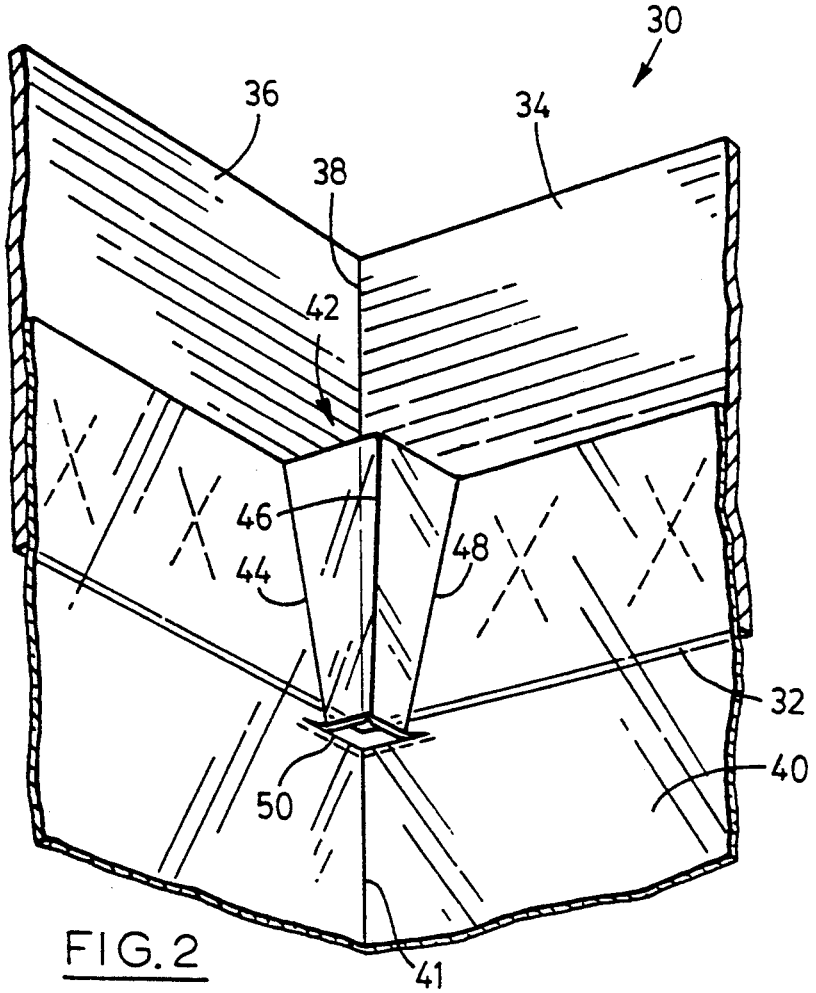
FIG. 2

FIG. 3
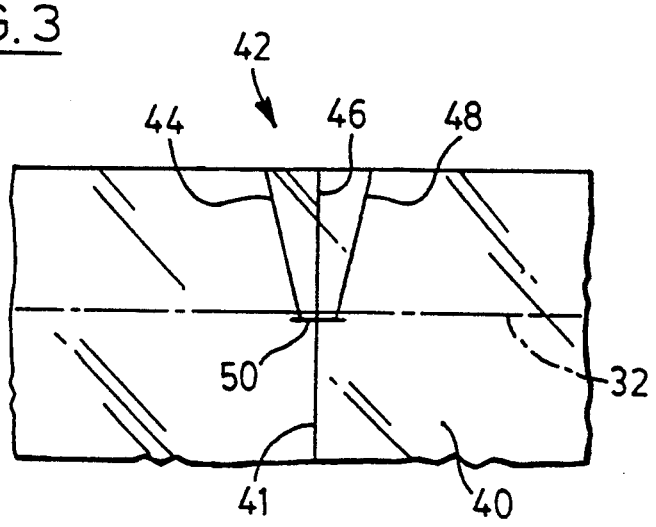
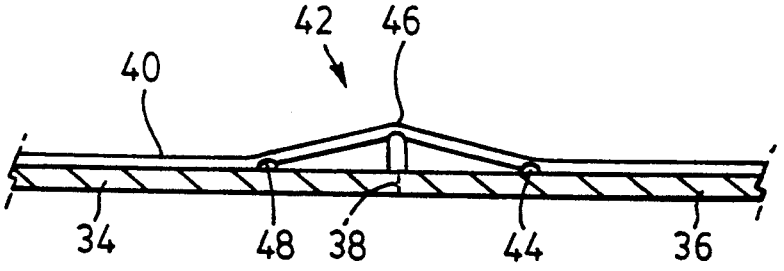
FIG. 4

DISPLAY BOX

This invention relates to display boxes and more particularly to a display box having a window formed by a semi-rigid transparent sheet which wraps around at least one corner of the box.

Display boxes with windows are commonly used to package consumer products. It is often desirable to provide a window which wraps around at least one corner of the box, thereby allowing the consumer a better view of the product. In this type of box, the semi-rigid transparent sheet which is used for the window should have sufficient rigidity and strength to keep the box in shape.

Problems may occur during manufacture of this type of display box because, when the corners of the box are folded, the transparent sheet, which is usually glued to the opaque material (usually cardboard) adjacent the window, may split the overlapping opaque material along the fold line at the corner of the box. One solution to this problem is shown in U.S. Pat. No. 3,199,670 (Palmer). In this patent, notches are cut in opposite ends of the semi-rigid transparent sheet at the corner of the box. Each notch extends from an end of the transparent sheet to the edge of the window opening in the semi-opaque material. Thus, the opaque material at the corner of the box does not overlap the transparent sheet and is not split thereby.

A problem with such prior art is that the cutting outof the notches is often carried out in such a manner that the resultant scraps of transparent sheet become electrostatically charged, with the result that their removal is difficult.

It is therefore an object of this invention to provide a display box having a window of semi-rigid transparent sheet which wraps around at least one corner of the box and does not involve the production of scraps of transparent sheet.

According to the invention, a display box comprises first and second opaque sides meeting at a corner and defining a window opening extending around the corner, and a semi-rigid transparent sheet in the window opening overlapping portions of the first and second opaque sides adjacent the window opening and secured thereto. The transparent sheet has a main fold line extending across the window opening in line with the corner and a corner portion at at least one end of the main fold line. The or each corner portion is formed by a first corner fold line in the transparent sheet adjacent the first opaque side and extending from the window opening to an adjacent end of the transparent sheet, a second corner fold line in the transparent sheet adjacent the second opaque side and extending from the window opening to the adjacent end of the transparent sheet, and a third corner fold line in the transparent sheet between the first and second fold lines and extending from the window opening to the adjacent end of the transparent sheet. When the box is in an erected configuration, the corner portion is raised away from the corner formed by the first and second opaque sides, the raised corner portion having a first segment between the first and third corner fold lines extending away from the first opaque side and a second segment between the second and third fold lines extending away from the second opaque side.

Thus, no scraps of transparent sheet are produced and the opaque material at the corner of the box does not contact the transparent sheet and does therefore is not split thereby.

The first, second and third corner fold lines preferably converge substantially to the corner at the window opening. The angle between the first and third fold lines is preferably substantially equal to the angle between the second and third fold lines. The angle may be in the range of from about 10° to about 45°, for example about 15°.

The or each corner portion may also comprise a slit in the transparent sheet extending across the main fold line adjacent an opaque side edge at the window opening, with the first, second and third fold lines extending to the slit.

One embodiment of the invention will now be described, by way of example, with reference to the accompanying drawings, of which:

FIG. 1 is a perspective view of a cardboard display box showing the window therein;

FIG. 2 is a fragmentary perspective view of the inside of the box of FIG. 1 showing a raised corner of the transparent sheet;

FIG. 3 is a plan view of the corner portion of the transparent sheet shown in FIG. 2 before attachment to the cardboard; and FIG. 4 is a side view of the corner portion of the transparent sheet shown in FIG. 3 attached to the cardboard but before the box is folded.

Referring to the drawings, FIGS. 1 and 2 show a cardboard display box 30 with a window opening 32 defined by two cardboard sides which meet at a corner 38. The window opening 32 extends around the corner 38 and is covered by a semi-rigid transparent sheet 40 of suitable synthetic plastic material.

The transparent sheet 40 has a main fold line 41 extending across the window opening 32 in line with the corner 38 and overlapping the cardboard sides 34, 36. The transparent sheet 40 is secured to the cardboard sides 34, 36 by glue represented by X marks in FIG. 2. To prevent the corner 38 from splitting adjacent the window opening 32 when the cardboard sides 34,36 are bent to a 90° angle, the transparent sheet 40 has a corner portion 42 at each end of the main fold line 41 which bends along pre-formed corner fold lines 44, 46 and 48 which converge and meet at the corner 38 just inside the window opening 32. When the box is erected, each corner portion 42 is raised away from the corner 38, thereby substantially eliminating the possibility of the corner 38 formed by the cardboard sides 34, 36 from splitting.

Each first corner fold line 44 is adjacent the cardboard side 36 and extends from the window opening 32 to the respective adjacent end of the transparent sheet 40. Each second corner fold line 48 is adjacent the cardboard side 34 and extends from the window opening 32 to the respective adjacent end of the transparent sheet 40. Each third corner fold line 46 is between the first and second corner fold lines 44, 48 and extends from the window opening 32 to the respective adjacent end of the transparent sheet 40.

The first, second and third corner fold lines 44, 48 and 46 converge substantially to the corner 38 at the window opening 32. The angle between the first and third corner fold lines 44, 46 is substantially equal to the angle between the second and third corner fold lines 48, 46 and is about 15°.

The transparent sheet 40 also has a slit 50 extending across opposite ends of the main fold line 41 adjacent each opaque side edge at the window opening 32. The first, second and third corner fold lines 44, 48 and 46 of each corner portion 42 extend to the respective slit 50.

FIG. 3 shows a corner portion of transparent sheet 40 before being folded along main fold line 41. A heated edge-forming tool (not shown) is applied to the top of the transparent sheet 40 along the third corner fold line 46, and heated edge-forming tools are applied to the bottom of transparent sheet 40 along the first and second corner fold lines 44, 48 as well as along main fold line 41. This creates a bias on the transparent sheet 40, as shown is FIG. 4, whereby third corner fold line 46 will be slightly raised from the remainder of the transparent sheet 40. First and second corner fold lines 44, 48 will cause raising of the corner portion 42 away from the cardboard sides 34, 36 as shown in FIG. 2, so that the likelihood of the cardboard sides 34, 36 being split at the corner 38 when the box is folded is substantially eliminated. The presence of the slit 50 assists in this respect.

It will be noted that each raised corner portion 42 has a first segment between the corner fold lines 44, 46 extending away from the cardboard side 36 and a second segment between the fold lines 48, 46 extending away from the cardboard side 34.

Other embodiments of the invention will be readily apparant to a person skilled in the art, the scope of the invention being defined in the appended claims.

I claim:

1. A display box comprising:

first and second opaque sides meeting at a corner and defining a window opening extending around said corner; and a semi-rigid transparent sheet in said window opening overlapping portions of said first and second opaque sides adjacent said window opening and secured thereto;

said transparent sheet having a main fold line extending across the window opening in line with said corner and a corner portion at at least one end of said main fold line, the or each corner portion being formed by a first corner fold line in said transparent sheet adjacent said first opaque side and extending from said window opening to an adjacent end of said transparent sheet;

a second corner fold line in said plastic sheet adjacent said second opaque side and extending from said window opening to the adjacent end of said transparent sheet; and a third corner fold line in said transparent sheet between said first and second fold lines and extending from said window opening to the adjacent end of said transparent sheet whereby, when the box is in an erected configuration, the corner portion is raised away from said corner formed by said first and second opaque sides, said raised corner portion having a first segment between said first and third corner fold lines extending away from said first opaque side and a second segment between said second and third fold lines extending away from said second opaque side.

2. A display box according to claim 1 wherein said first, second and third corner fold lines converge substantially to said corner at said window opening.

3. A display box according to claim 2 wherein the angle between said first and third fold lines is substantially equal to the angle between said second and third fold lines.

4. A display box according to claim 3 wherein said angle is in the range of from about 10° to about 45°.

5. A display box according to claim 4 wherein said angle is about 15°.

6. A display box according to claim 1 wherein the or each corner portion also comprises a slit in said transparent sheet extending across said main fold line adjacent an opaque side edge of said window opening, said first, second and third fold lines extending to said slit.

* * * * *